United States Patent [19]

Moreno

[11] Patent Number: 4,784,600

[45] Date of Patent: Nov. 15, 1988

[54] LOW $NO_x$ STAGED COMBUSTOR WITH SWIRL SUPPRESSION

[75] Inventor: Frederick E. Moreno, Los Altos, Calif.

[73] Assignee: PruTech II, San Jose, Calif.

[21] Appl. No.: 916,570

[22] Filed: Oct. 8, 1986

[51] Int. Cl.[4] ..... F23M 3/00

[52] U.S. Cl. ..... 431/9; 431/10; 431/351; 60/732; 60/748

[58] Field of Search ..... 431/9, 10, 351, 115; 60/732, 748

[56] References Cited

U.S. PATENT DOCUMENTS

| | | | |
|---|---|---|---|
| 2,398,654 | 4/1946 | Lubbock et al. | 60/748 |
| 3,872,664 | 3/1975 | Lohmann et al. | 431/9 |
| 4,500,281 | 2/1985 | Beardmore | 431/10 |

*Primary Examiner*—Carroll B. Dority, Jr.
*Attorney, Agent, or Firm*—Harry E. Aine

[57] ABSTRACT

In a low $NO_x$ stage combustor, the hot fuel rich combustion gases exit the primary combustion chamber through a constriction including a throat portion and pass into a secondary combustion chamber wherein burning is completed by injection of secondary air such as the exhaust from a turbine. Swirl is imparted to the primary gas stream in the primary combustion chamber so as to cause the primary gas stream to fill the entire primary combustion chamber and for increasing the residence time within the primary chamber for reducing fuel $NO_x$ emissions. Swirl suppression means are employed in the throat of the flow constrictor, between the primary and secondary combustion chambers, for suppressing swirl in the outermost regions of the primary gas stream so as to reduce turbulent mixing with the injected, secondary air thereby reducing the peak flame temperature in the secondary combustion chamber and for reducing thermal $NO_x$ emissions. The swirl suppression means comprises means for roughing the throat of the flow constrictor such as by forming lands and grooves in a castable, refractory material lining the interior wall of the throat.

12 Claims, 2 Drawing Sheets

LOW $NO_x$ STAGED COMBUSTOR WITH SWIRL SUPPRESSION

BACKGROUND OF THE INVENTION

The present invention relates in general to low $NO_x$ staged combustors and, more particularly, to such combustors which introduce swirl into the fuel-air mixture in the fuel-rich primary combustion zone.

DESCRIPTION OF THE PRIOR ART

Heretofore, low $NO_x$ staged combustors have been proposed to control the formation of fuel $NO_x$ in oilfield boilers fired with nitrogen-containing heavy crude oil. In these prior art combustors, fuel and air are introduced through a burner register that fires into a fuel-rich primary zone. The burner register contains swirl vanes to swirl the flow such that the flow (and subsequent flame pattern) spread out to fill a primary combustion chamber. The swirl is controlled to spread the flow, but is low enough that no recirculation zone forms within the primary zone. In this way, the entire volume of the primary zone is efficiently used.

Next, the flow passes through a reduced diameter region termed the "throat" before entering the radiant zone of the boiler. A ring of secondary air injection ports, coaxial with the primary zone throat, add the balance of the combustion air required for complete combustion. The throat region is required to prevent backmixing of secondary air into the primary zone, and to shape the flame to prevent flame impingement on the walls of the boiler radiant zone. Such an oilfield boiler is described in an article appearing in the proceedings of the 1982 Joint Symposium of Stationery Combustion $NO_x$ Control, Vol. 2, Paper No. 45, entitled: "Development of a low $NO_x$ burner for enhanced oil recovery".

While staged combustion has been proven to be effective in the control of fuel $NO_x$, staged combustion burners can still produce substantial amounts of thermal $NO_x$ in the secondary zone. This occurs when the peak flame temperatures, coupled with the presence of oxygen (from the secondary air) are sufficiently high to permit thermal $NO_x$ chemical reactions to take place. The above described prior art burner produced final $NO_x$ emissions of approximately 73 ppm (referenced to 3% oxygen in the exhaust). This compares favorably to $NO_x$ emissions of nominally 400 to 500 ppm on oilfield burners operated with no $NO_x$ controls.

By experiments with this prior art unit and precursor laboratory units, it is estimated that approximately 40 ppm of the total $NO_x$ is attibutable to thermal $NO_x$ formed in the secondary region. Thus, while the burner design ultimately controls fuel $NO_x$ formation, over half of the $NO_x$ emitted is formed through thermal processes. Because the trend of regulations is toward still tighter $NO_x$ controls in some geographic regions, it is desirable to further reduce $NO_x$ emissions.

It is also known from the prior art in two stage combustors that in order to suppress the formation of $NO_x$ during the secondary combustion, that it is important to avoid formation of local, high temperature regions and a local, oxygen rich region secondary zone, and to lower the combustion temperature therein.

One prior proposal involved dividing the primary flow exiting the primary combustion zone into a plurality of jets by means of a plurality of nozzles and injecting the secondary air through an annulus coaxial with the primary gas jets so as to cause the combustion in the secondary combustion zone to take place after dissipating heat sufficiently and being cooled enough so that the formation of $NO_x$ is suppressed. Such an arrangement is disclosed in U.S. Pat. No. 4,021,188 issued May 3, 1971.

One of the problems with dividing the flow exiting the primary zone by means of a plurality nozzles is that the gas temperature exiting the primary zone, for such oilfield boilers, is on the order of 2800° to 2900° F. which is sufficiently hot to destroy all but the most exotic, very high temperature refractory insulation materials which would result in excessive construction costs for the nozzles.

SUMMARY OF THE PRESENT INVENTION

The principal object of the present invention is the provision of an improved, low $NO_x$ staged combustor of the type wherein swirl is introduced into the flow of the fuel-air mixture in the primary zone.

In one feature of the present invention, swirl suppressing means are disposed within the throat of the primary combustion chamber where the primary burning gas exits the primary chamber into the secondary chamber for reducing the swirl of the outermost regions of the primary gas stream, whereby turbulent mixing of the primary and secondary gas streams is substantially reduced with subsequent reductions in flame temperatures and final thermal $NO_x$ emissions.

In another feature of the present invention, the swirl suppression means comprises a plurality of protrusions on the inside wall of the throat which protrude into the outermost regions of the primary gas stream exiting the primary combustion chamber.

In another feature of the present invention, the protrusions are longitudinally directed to form lands and grooves in the inside wall of the throat for suppressing the swirl of the outermost region of the primary gas stream, as injected into the secondary chamber.

In another feature of the present invention, the swirl suppression protrusions are made of a fibrous alumina refractory material.

In another feature of the present invention, the swirl suppression protrusions protrude from the inside wall of the throat into the primary gas stream by an amount falling within the range of 10 to 20 percent of the average radius of the primary gas stream within the throat, whereby fabrication of the swirl suppression protrusions is facilitated without introducing excessive pressure drop in the flow of the primary gas stream through the throat into the secondary combustion region.

In another feature of the present invention, the axial velocities of the injected, secondary air and of the outermost region of the primary gas stream at their confluence are chosen such that the ratio of their axial velocities fall within the range of 0.8 to 1.2 for reduced turbulent mixing.

Other features and advantages of the present invention will become apparent upon a perusal of the following specification taken in connection with the accompanying drawings wherein:

DESCRIPTION OF THE PREFERRED EMBODIMENTS

Figure 1:
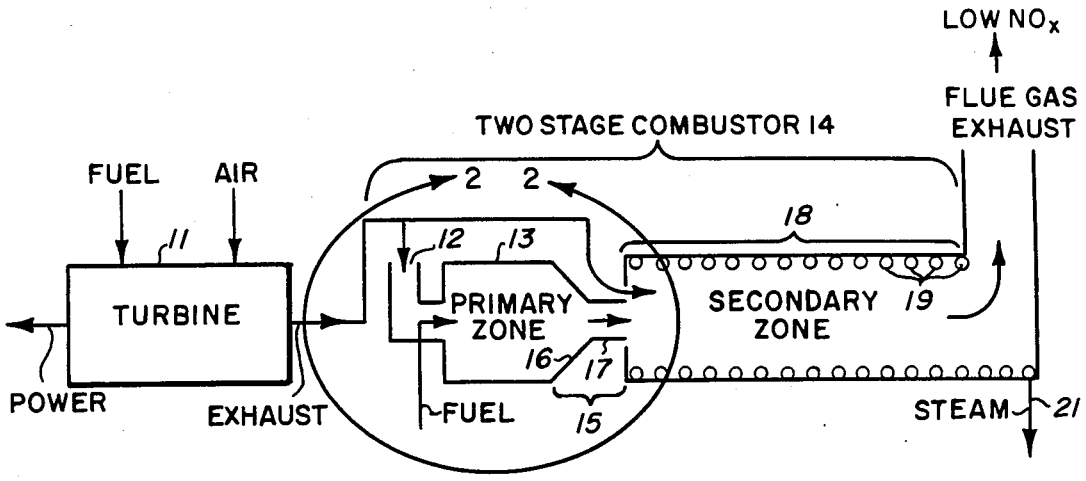
Fig 1 (PRIOR ART)
FIG. 1 is schematic line diagram, partly in block diagram form, of a prior art co-generation system employing two-stage combustion.
Figure 2:
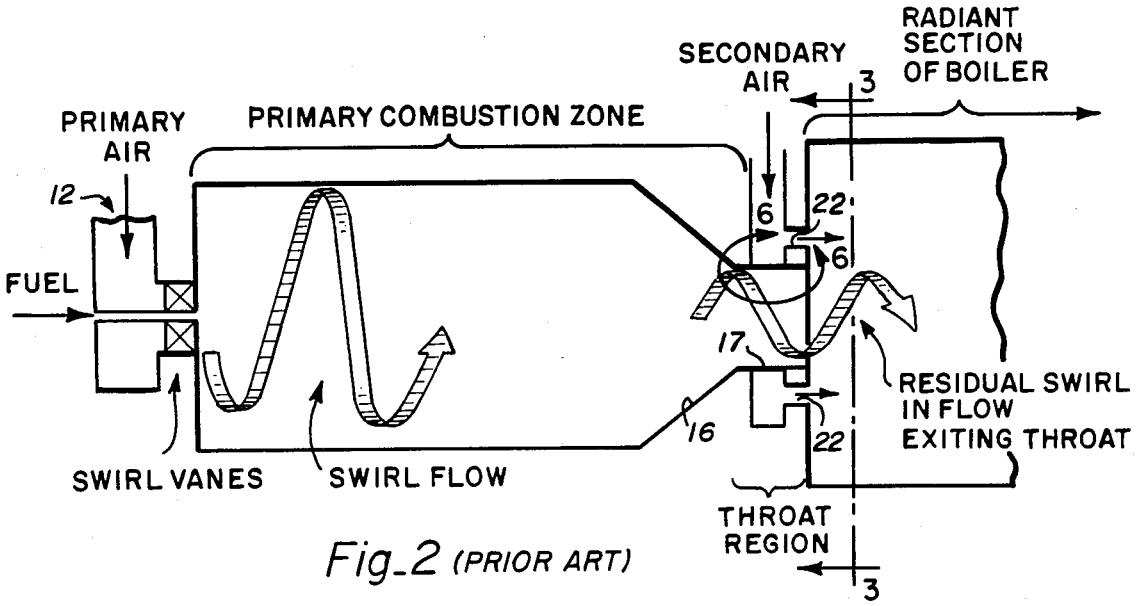
Fig 2 (PRIOR ART)
FIG. 2 is an enlarged view of a portion of the structure of FIG. 1 delineated by line 2—2.
Figure 3:
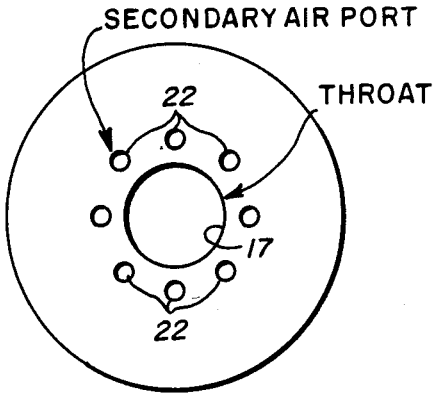
Fig 3 (PRIOR ART)
FIG. 3 is a sectional view of the structure of FIG. 2 taken along the line 3—3 in the direction of the arrows.

Referring now to FIG. 1, there is shown a co-generation system employing a two-stage combustor for use in the oilfields. In this system, an oil-fired turbine 11 is coupled to a generator, not shown, for generating electrical power and producing exhaust gases at about 1200° F. containing approximately 15% oxygen. A portion of the exhaust gas is fed into the air intake 12 of a primary combustion chamber 13, of a two-stage combustor 14 wherein the turbine exhaust is mixed with fuel comprising heavy nitrogen containing crude oil, such as California crude.

Combustion conditions in the primary combustion chamber 13 are arranged so that the fuel and air in the turbine exhaust burn in the primary combustion chamber in a fuel-rich manner, i.e., with 70% or less stoichiometric oxygen. The turbine exhaust is fed into the primary combustion chamber through a plurality of swirl vanes arranged for imparting a moderate swirl having a swirl number falling within the range of 0.3 to 0.5, to the flow of gases in the primary combustion chamber 13. This causes the primary gas stream to expand and to increase the residence time within the primary combustion chamber 13. Swirl Number is defined as the ratio of angular momentum of the flow to axial momentum of the flow.

In a typical example, the primary combustion chamber has an inside diameter of approximately 7.5' and a length of approximately 13.5' and includes approximately 10" of refractory insulation material lining the interior walls thereof. The flame temperatures within the primary combustion zone typically reach temperatures of between 2800° and 2900° F.

The hot combustion gases exit the primary combustion chamber 13 through a transition region 15 which includes a constrictor portion 16 which constricts the diameter of the flow stream and the stream, as constricted, then exit through a throat portion 17 into the secondary combustion chamber 18. The secondary combustion chamber 18 includes water boiler pipes 19 lining the interior of the secondary combustion chamber 18 for removing heat from the secondary combustion chamber and for converting the heat into steam which is drawn off at 21.

The remainder of the turbine exhaust is fed, as secondary air, into the entrance to the secondary combustion chamber 18 in a flow pattern coaxially surrounding the outer periphery of the primary gas stream exiting the primary combustion chamber 13, at the exit of the throat portion 17. The secondary air contains approximately 15% oxygen and is at a temperature of approximately 1200° F. and is fed into the secondary combustion chamber 18 through a plurality of ports 22 coaxially of and disposed around the periphery of the throat portion 17.

In a typical example, the flow constricting portion 16 of the transition 15 has axial length of approximately 4' and necks the flow down from a diameter of approximately 7.5' to approximately 3', which is the diameter of the throat portion 17. The throat portion 17 has an axial length of between 2' and 3' and the axial velocity of the primary gas stream exiting the primary combustion chamber at the throat 17 is approximately 100' , per second.

The turbine exhaust secondary air enters the secondary combustion chamber 18 through eight ports 22 which typically have a diameter of 8.7" and an axial length of approximately 6". The ports 22 are typically provided in a stainless steel plate lined with a refractory insulative material as of 6" in thickness The ring of secondary air injection ports 22 adds the balance of the combustion air required to complete combustion. The throat region 17 is required to prevent backmixing of secondary air into the primary zone, and to shape the flame in the secondary zone to prevent flame impingement on the walls of the boiler radiant zone or secondary zone.

Figure 4:
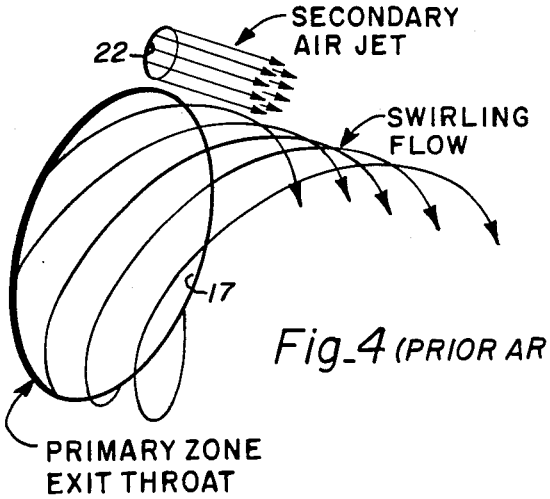
Fig 4 (PRIOR ART)
FIG. 4 is a schematic diagram depicting the flow patterns for the primary and secondary gas streams at the entrance to the secondary combustion zone.

It has been discovered that in the prior art two-stage combustor 14, that there was residual swirl in the primary gas stream exiting the primary zone. As noted above, swirl is added to the flow entering the primary zone to force the flow to fully occupy the full volume of the primary combustion chamber 13. Frictional forces cause the swirl to partially decay as the flow passes through the primary combustion chamber 13. A key discovery has been that swirl persists in the primary combustion chamber such that when the flow is forced to contract through the constrictor and throat regions 16 and 17, separating the primary and secondary zones, conservation of angular momentum causes an increase in the tangential component of velocity of the exiting primary gas, resulting in higher swirl within the throat 17 and immediately exiting the throat 17. A portion of the resulting flow pattern is shown in FIG. 4.

Figure 5:
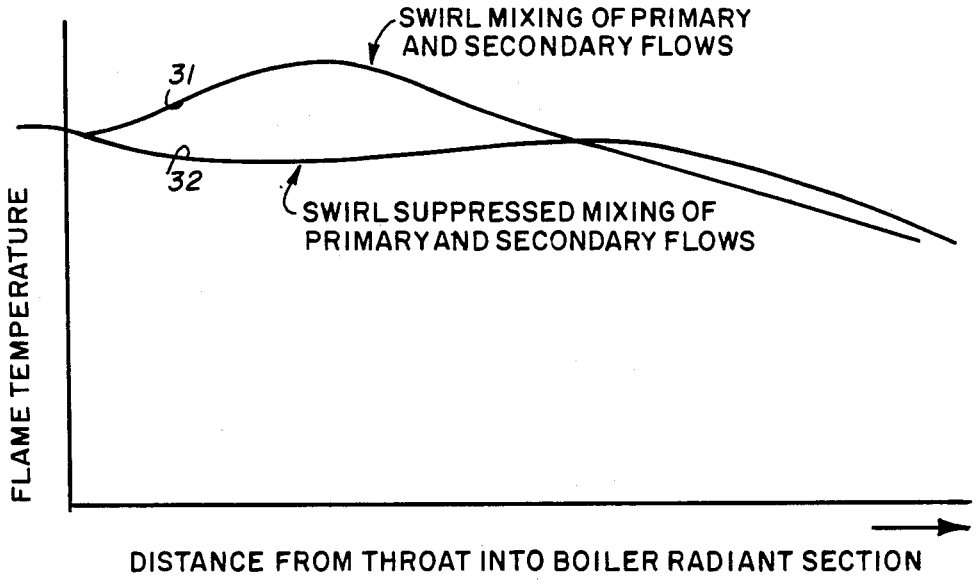
FIG. 5 is a plot of flame temperature vs. distance from the throat into the secondary combustor for a prior art system and for the swirl suppression system of the present invention.

The relative motion of the swirling flow exiting the throat 17 and the secondary air jets, which exit ports 22 coaxially with throat 17, results in a shear flow between the primary and secondary flow. The shear flow being unstable results in the formation of turbulence and subsequent increased mixing. The increased mixing leads to higher local flame temperatures and thereby contributes to the formation of thermal $NO_x$. This increased temperature profile is shown at curve 31 of FIG. 5.

More than half of the $NO_x$ produced by the prior art combustor of FIGS. 1–4 is estimated to originate from thermal $NO_x$ formation mechanisms which operate in the secondary combustion chamber 18. The level of thermal $NO_x$ formed is sensitive to the flame temperatures which occur in the secondary zone. The flame temperature that occurs is a consequence of two competing processes. First, the mixing of secondary air into fuel-rich flame exiting the burner throat 17 results in additional energy-releasing combustion as unburned fuel exiting the primary zone reacts with the oxygen of the secondary air, thereby tending to increase flame temperature. Simultaneously, the flame in the secondary zone radiates thermal energy to the cooler boiler tubes 19, which line the boiler radiant section that encircles the secondary zone. This radiant heat transfer reduces the flame temperature.

Reduction of the intensity of mixing between the primary flow, exiting the throat 17, and the secondary jet flow, exiting ports 22, will reduce the flame intensity in the secondary zone, stretching out the length over which the combustion energy is released, increasing the time available for radiant heat transfer, and, thus, reducing the peak temperatures which occur in the secondary zone.

In the present invention, the shear flow between the primary and secondary flows, which results in increased mixing and thus higher local flame temperatures, is reduced by suppressing the swirl in the flow exiting the primary zone, or more specifically, by reducing the tangential component of velocity that leads to shear and subsequent formation of turbulence. The resultant reduced mixing will reduce peak flame temperatures as shown by curve 32 of FIG. 5. Correctly designed "wall roughness" in the primary zone (most effectively in the throat region 17 of the primary zone is employed to suppress the residual swirl and thereby obtain a flow that exits the throat 17 essentially parallel to the throat centerline. With the flows of the primary gas and of the secondary injection air parallel and coaxial, the formation of shear flows and subsequent turbulent mixing are substantially reduced with subsequent reduction in flame temperature.

It is not necessary to suppress the swirl throughout the entire flow exiting the throat 17. It is only desired to suppress the tangential component of velocity in the outermost regions of the throat flow, those regions which first come into contact with the secondary air jets. Thus, it is acceptable to permit some swirl to remain within the central core of the throat flow The residual swirl within the core of the primary flow helps to broaden the flame shape farther into the secondary combustion chamber 18 for improving radiant heat transfer. Because of this, it is not necessary to use flow splitters or vanes which extend all the way across the throat 17 as a means of reducing swirl. Such means would be difficult to construct using high temperature refractory materials, (the only materials which could survive the 2800° temperatures typically of the throat 17), and would contribute to increase pressure drop of the flow through the throat 17.

Figure 6:
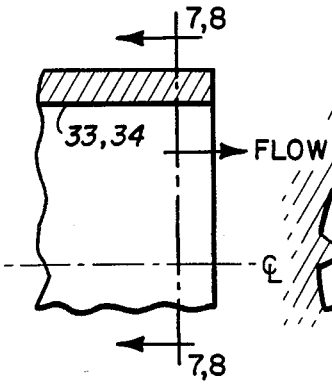
FIG. 6 is a fragmentary, sectional view of a portion of the throat delineated by line 6—6 of FIG. 2.
Figure 7:
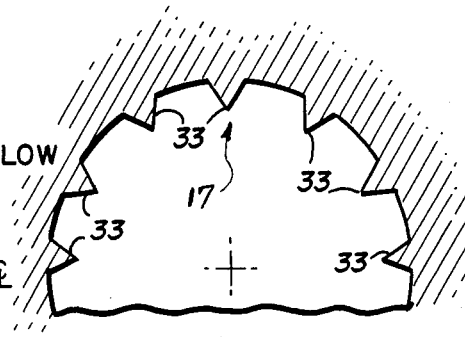
FIG. 7 is the sectional view of the structure of FIG. 6 taken along line 7—7 in the direction of the arrows.
Figure 8:
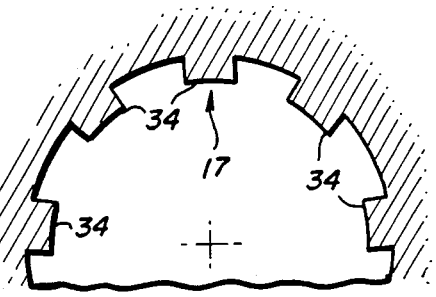
FIG. 8 is a sectional view of an alternative embodiment of the structure of FIG. 6 taken along line 8—8 in the direction of the arrows.

Referring now to FIGS. 6–8, there is illustrated two types of wall roughness that can be employed to suppress swirl in the flow exiting the primary zone. By forming the throat region 17 of a high temperature castable refractory, such as Greencast-97-L, made by A. P. Green Co., of Mexico: Mo., the wall roughness shapes are cast into the refractory wall and oriented parallel to the throat centerline for reducing the tangential component of velocity in the primary flow stream while permitting the axial component of flow to continue relatively unimpeded. As an alternative, the throat wall is made of high alumina fiber block refractory insulative material and the wall roughness structure is cut into the material.

In a preferred embodiment, the throat region 17 has a length that is 50–100% of its diameter, and triangular cross-sections lands 33 or rectangular cross-section lands 34, FIGS. 7 and 8 respectively, as cast into the walls of the throat 17, have a height extending nominally 10-20% of the throat average radius into the primary flow stream. Longer extensions of the lands 33 or 34 are mechanically unsound when the shapes are formed of castable, refractory material and smaller extensions will lack effectiveness in reducing the swirl in the short distance available in the throat region 17.

In a typical example, lands 33 are of a height of approximately 2" as cut into the surface of a 4" layer of 10–20 lb. per cubic foot density, 90% plus high alumina fiber block refractory insulation, commercially available from Babcock and Wilcock of Augusta, Georgia. The lands and grooves are covered with a 1/16" thickness of Unicoat protective coating, commercially available from Babcock and Wilcock and capable of withstanding 3,000° F. The 4" thick refractory fiber block material is cemented at its outer periphery to a 6" thick layer of fiber block insulation by means of a high temperature cement, such as Unistick cement commercially available from Babcock and Wilcock, such cement having a thickness as of 0.250". The 6" thick layer of fiber block insulation, preferably comprises silica and alumina fibers with a density of 10–20 lbs. per cubic ft., and is commercially available from Babcock and Wilcock.

Also, the axial flow velocities of the primary and secondary gas streams, at their point of confluence in the secondary combustion chamber 18, are proportioned such that their ratio falls within the range of 0.8 to 1.2 whereby turbulent mixing is inhibited and thermal $NO_x$ suppressed.

The advantage to the roughened throat portion of the present invention is that it reduces the residual swirl mixing of the primary and secondary flows resulting in reducing the peak temperatures in the secondary combustion chamber with a resultant reduction in thermal $NO_x$ emissions.

What is claimed is:

1. In a low $NO_x$ emission staged combustion burner of the type having a primary combustion chamber fired with a fuel-rich mixture of fuel and an oxygen-containing primary gas stream, followed by a secondary combustion chamber fired with a fuel mixture of hot fuel-containing gas exiting the primary chamber and an oxygen-containing secondary gas stream:

swirl means for imparting swirl to the primary burning gas stream of fuel and oxygen-containing gas in the primary combustion chamber to cause the primary gas stream to fill the primary combustion chamber and to increase the residence time of the primary burning gas in the fuel-rich primary combustion chamber of reducing final $NO_x$ emissions;

transition means for substantially constricting the cross-sectional area of the primary stream of burning gas exiting the primary combustion chamber and for feeding the constricted primary gas stream into the secondary combustion chamber for preventing backmixing of gases from the secondary combustion chamber and for preventing flame impingement on the walls of the secondary combustion chamber;

secondary injector means for injecting a secondary oxygen-containing gas stream into the secondary combustion chamber and about the primary gas stream of burning gas exiting and said transition means in a direction generally parallel and coaxially thereto;

swirl suppressing means made of a refractory nonmetallic material disposed within and extending along said transition means and protruding into essentially only the outer periphery of the gas stream exiting the primary combustion chamber for substantially reducing the swirl of the outermost regions of the primary gas stream exiting said transition means and for substantially reducing turbulent mixing of the parallel and coaxially travelling primary and secondary gas streams and for reducing the flame temperature in the secondary combustion chamber and thermal $NO_x$ emissions therefrom.

2. The burner of claim 1 wherein said swirl suppression means includes refractory non-metallic protrusions on an inside wall of said transition means protruding into the outermost regions of the primary gas stream exiting the primary combustion chamber.

3. The burner of claim 2 wherein said protrusions are axially directed lands and grooves formed in the refractory non-metallic inside wall of said transition means.

4. The burner of claim 2 wherein said protrusions are made of a material selected from the group consisting of fibrous alumina refractory material, and castable refractory material.

5. The burner of claim 2 wherein said transition means includes a throat portion of minimum, cross-sectional area and corresponding to the region of primary gas stream flow of maximum flow velocity and wherein said protrusions protrude from said throat portion into the primary gas stream by an amount falling within the range of 10–20% of the average radius of the primary gas stream within said throat portion.

6. The burner of claim 5 wherein said throat portion has an axial length falling within the range of 50–100% of its diameter.

7. The apparatus of claim 1 wherein said swirl means imparts a swirl to the primary gas stream within the primary combustion chamber having a swirl number falling within the range of 0.3 to 0.5.

8. In a method for reducing $NO_x$ emissions from a staged combustion burner of the type having a primary combustion chamber fired with a fuel-rich mixture of fuel and an oxygen-containing primary gas stream followed by a secondary combustion chamber fired with a fuel mixture of hot fuel-containing gas exiting the primary chamber and an oxygen-containing secondary gas stream, the steps of:

imparting swirl to the primary burning gas stream of fuel and oxygen-containing gas in the primary combustion chamber to cause the primary burning gas stream to fill the primary combustion chamber and to increase the residence time of the primary burning gas stream in the fuel-combustion zone for reducing final $NO_x$ emissions;

substantially constricting the cross-sectional area of the primary gas stream exiting the primary combustion chamber to substantially increase its axial velocity to prevent backmixing of gases from the secondary combustion chamber and to prevent flame impingement on the walls of the secondary combustion chamber;

feeding the constricted primary gas stream exiting the primary combustion chamber into the secondary combustion chamber;

injecting an oxygen-containing secondary gas stream into the secondary combustion chamber and about the primary gas stream exiting the primary chamber, such secondary gas stream directed in a direction generally parallel and coaxially to said primary gas stream as fed into the secondary combustion chamber; and providing longitudinally extending portions about and protruding into the outer periphery of the constricted primary gas stream and suppressing the residual swirl in essentially only the outermost peripheral region of the constricted, primary gas stream exiting the primary combustion chamber for substantially reducing the turbulent mixing of the parallel and coaxial primary and secondary gas streams in the secondary combustion chamber with an attendant reduction in frame temperature and final thermal $NO_x$ emissions.

9. The method of claim 8 wherein the step of suppressing the residual swirl of the primary gas stream exiting the primary combustion chamber includes the step of:

providing refractory non-metallic protrusions extending into the outermost peripheral regions of the primary gas stream in the flow-constricted region of the primary gas stream.

10. The method of claim 9 including the step of providing the protrusions with the form of elongated lands and grooves elongated in the axial direction of the primary gas stream.

11. The method of claim 9 wherein the step of providing the protrusions extending into the primary gas stream includes the step of casting the protrusions into a refractory non-metallic material forming the sidewalls of the flow-constricting region of the primary gas stream passageway.

12. The method of claim 8 including the step of proportioning the ratio of axial components of velocity of the primary and secondary gas streams to be within the range of 0.8 to 1.2.

* * * * *